US008320798B2

(12) United States Patent
Nanno et al.

(10) Patent No.: US 8,320,798 B2
(45) **Date of Patent: *Nov. 27, 2012**

(54) SHEET CONVEYING DEVICE AND IMAGE FORMING APPARATUS

(75) Inventors: Shigeo Nanno, Kyoto (JP); Hiroshi Fujiwara, Osaka (JP); Yasuhide Ohkubo, Osaka (JP); Ippei Kimura, Osaka (JP); Yoshihide Ohta, Osaka (JP); Tomoyoshi Yamazaki, Osaka (JP); Masafumi Takahira, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,829

(22) Filed: Sep. 15, 2011

(65) Prior Publication Data

US 2012/0007307 A1 Jan. 12, 2012

Related U.S. Application Data

(63) Continuation of application No. 11/636,996, filed on Dec. 12, 2006, now Pat. No. 8,045,888.

(30) Foreign Application Priority Data

Jan. 26, 2006 (JP) ..... 2006-018167

(51) Int. Cl.
*G03G 21/00* (2006.01)

(52) U.S. Cl. ..... 399/124; 399/401; 399/393

(58) Field of Classification Search ..... 399/124, 399/391, 393, 401
See application file for complete search history.

(56) References Cited

U.S. PATENT DOCUMENTS

| | | | | |
|---|---|---|---|---|
| 6,674,983 | B2 | 1/2004 | Enomoto et al. | |
| 2002/0054777 | A1 * | 5/2002 | Itoh et al. | 399/401 |
| 2005/0129439 | A1 | 6/2005 | Asano | |
| 2006/0285905 | A1 * | 12/2006 | Choung | 399/401 |

FOREIGN PATENT DOCUMENTS

| | | | |
|---|---|---|---|
| JP | 06-127711 | | 5/1994 |
| JP | 07-234559 | | 9/1995 |
| JP | 07234559 | A * | 9/1995 |
| JP | 11-060081 | | 3/1999 |
| JP | 2004-029289 | | 1/2004 |
| JP | 2004-203496 | | 7/2004 |
| JP | 2005-112478 | | 4/2005 |
| JP | 2001-125321 | | 5/2011 |

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

A conveying device conveys a sheet of non-blank recording medium recorded with an image formed in an image forming unit, and includes a container that is detachable and contains a sheet of blank recording medium, a feeding unit that feeds the blank recording medium from the container, and a recirculating path that leads the non-blank recording medium to the feeding unit. The recirculating path is disposed lateral to the image forming unit. A part of the recirculating path is integrated into the container and forms a reversing path that leads to the feeding unit. At least one of surfaces of the reversing path can be exposed.

16 Claims, 4 Drawing Sheets

SHEET CONVEYING DEVICE AND IMAGE FORMING APPARATUS

CROSS-REFERENCE TO RELATED APPLICATIONS

This application is a continuation of and claims priority under 35 U.S.C. §§120/121 to U.S. patent application Ser. No. 11/636,996, filed on Dec. 12, 2006, now U.S. Pat. No. 8,045,888 which claims the benefit of Japanese patent application no. 2006-018167, filed on Jan. 26, 2006. The disclosures of each of the above applications are incorporated herein by reference.

BACKGROUND OF THE INVENTION

1. Field of the Invention

The present invention relates to a conveying device that conveys a recording medium for duplex printing in an image forming apparatus.

2. Description of the Related Art

An image forming apparatus such as a copier, a printer, a facsimile, and a printing machine uses a technology for forming an image on a recording medium such as recording paper by electrophotography. The image forming apparatus can form the image in monochrome or in multicolor. In either case, a development device visualizes an electrostatic latent image formed on a photoreceptor that is used as a latent image holder, the visualized image is transferred to the recording paper, and then the image is fixed.

There have been increasing needs for a technology for forming images on both sides of the recording paper, and there is a technology for reversing a sheet of the recording paper with the image fixed on one side and then transferring another image on the other side.

For example, paragraph 0014 in Japanese Patent Laid-open No. H11-60081 discloses a technology for reversing a conveying direction of the fixed recording paper in a reverse conveying path below an imaging unit that forms and transfers an image, and feeding the paper to a transfer position by a resisting roller.

However, the technology involves the following problems. Because a reverse conveying unit is provided below the imaging unit in a chassis of the image forming apparatus, the image forming apparatus is tall.

Moreover, if a conveyance failure such as a paper jam occurs to the reverse conveying unit below the imaging unit, the failure cannot be easily fixed because the reverse conveying unit cannot be easily exposed.

SUMMARY OF THE INVENTION

It is an object of the present invention to at least partially solve the problems in the conventional technology.

According to an aspect of the present invention, a conveying device, which conveys a sheet of non-blank recording medium printed with an image formed in an image forming unit, includes a container that is detachably disposed below the image forming unit in a chassis and contains a blank recording medium; a feeding unit that feeds the blank recording medium from the container to the image forming unit, wherein the image forming unit forms a first image on a first surface of the blank recording medium; and a recirculating path that leads the recording medium having the first image printed on the first surface to the feeding unit, wherein the feeding unit feeds the recording medium having the first image printed on the first surface to the image forming unit, and the image forming unit forms a second image on a second surface of the recording medium having the first image printed on the first surface, wherein the recirculating path is disposed lateral to the image forming unit, a part of the recirculating path is integrated into the container and forms a reversing path that leads to the feeding unit, and at least one of surfaces of the reversing path can be exposed.

According to another aspect of the present invention, an image forming apparatus includes an image forming unit that records a first image on a first surface of blank recording medium; and a conveying device. The conveying device includes a container that is detachably disposed below the image forming unit in a chassis and contains a sheet of the blank recording medium; a feeding unit that feeds the blank recording medium from the container to the image forming unit, wherein the image forming unit forms a first image on a first surface of the blank recording medium; and a recirculating path that leads the recording medium having the first image printed on the first surface to the feeding unit, wherein the feeding unit feeds the recording medium having the first image printed on the first surface to the image forming unit, and the image forming unit forms a second image on a second surface of the recording medium having the first image printed on the first surface, wherein the recirculating path is disposed lateral to the image forming unit, a part of the recirculating path is integrated into the container and forms a reversing path that leads to the feeding unit, and at least one of surfaces of the reversing path can be exposed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below in detail referring to the accompanying drawings. The present invention is not limited to the embodiments explained below.

Figure 1:
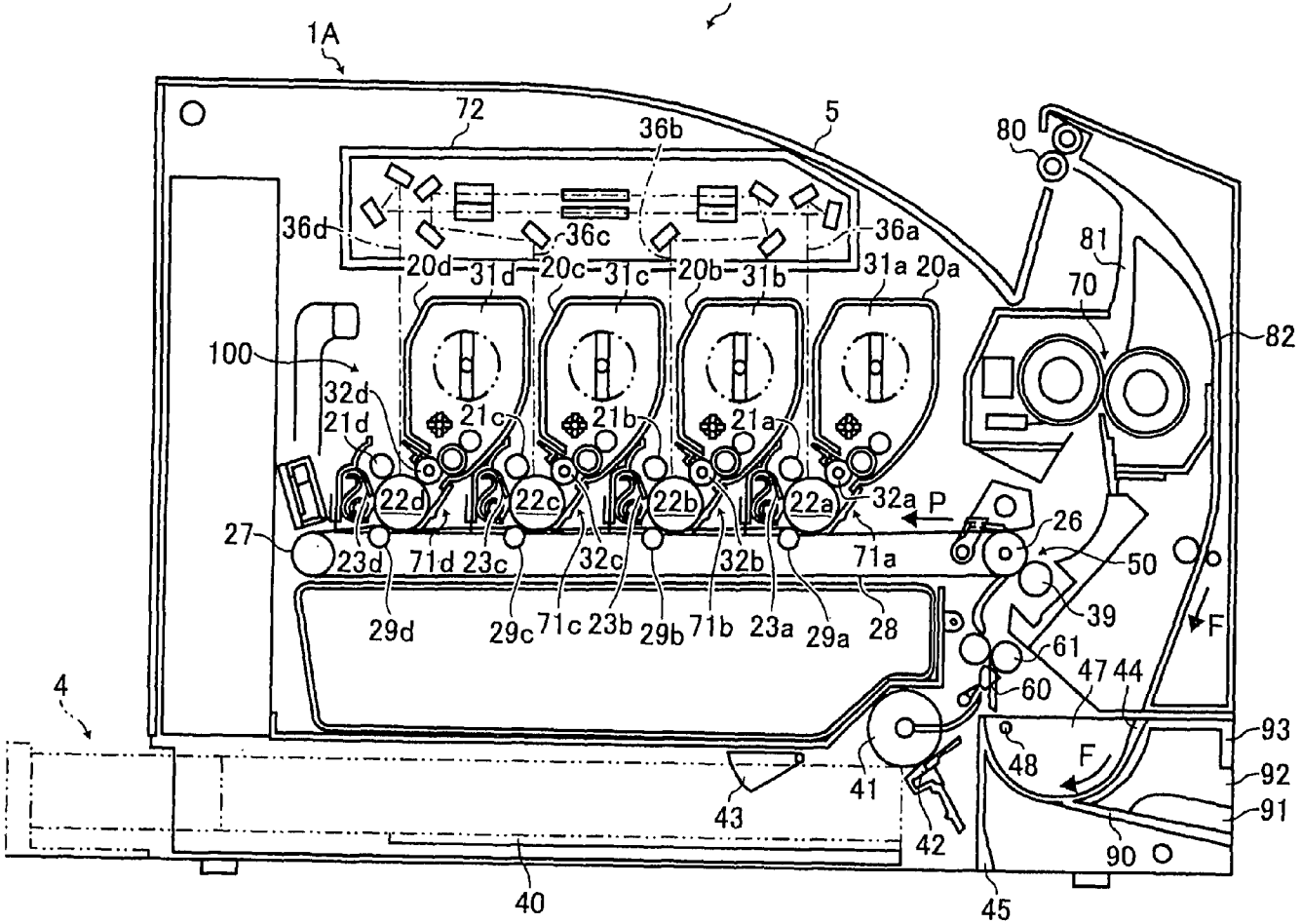
FIG. 1 is a schematic of an image forming apparatus that includes a conveying device according to an embodiment of the present invention.

FIG. 1 is a schematic of an image forming apparatus that includes a conveying device according to an embodiment of the present invention. The image forming apparatus shown in FIG. 1 is a color printer that forms a multicolor image. However, the image forming unit according to the present invention can be a copier, a printing machine, a facsimile, or the like. While the image forming unit in FIG. 1 prints an image on a recording medium by electrophotography, the image can be printed by an inkjet system.

A color printer 1 includes imaging units 71*a* to 71*d* that include a photoreceptor used as a latent image holder and a unit that performs a charging process, a developing process, and a cleaning process to the photoreceptor with respect to each color. The color printer 1 uses a tandem system in which the imaging units 71*a* to 71*d* are arranged in parallel with one another along an extension of an intermediate transfer belt 28. The intermediate transfer belt 28 is used to sequentially transfer images in different colors formed by the corresponding imaging unit.

The color printer 1 includes a chassis 1A that houses an image forming unit 100, and the image forming unit 100 is disposed substantially at half the height of the chassis 1A. An optical scanning unit 72 is provided above the image forming unit 100, and a feeding unit 4 is provided below the image forming unit 100. The feeding unit 4 includes a feeding cassette that contains recording medium sheets such as recording paper (hereinafter, "recording paper").

The imaging units 71*a* to 71*d* function as latent image holders, and include image holding units 20*a* to 20*d*, respectively. The image holding units 20*a* to 20*d* include photoreceptors (hereinafter, "photoreceptor drums") 22*a* to 22*d*, charged rollers 21*a* to 21*d*, developing units 31*a* to 31*d*, and cleaning units 23*a* to 23*d*, respectively. Each of the photoreceptor drums 22*a* to 22*d* is in the shape of a drum and rotates in a clockwise direction. Each of the charged rollers 21*a* to 21*d* contacts corresponding one of the photoreceptor drums 22*a* to 22*d*. Each of, the developing units 31*a* to 31*d* includes corresponding one of developing rollers 32*a* to 32*d* that visualizes electrostatic latent images formed by one of the photoreceptor drums 22*a* to 22*d*. Each of the cleaning units 23*a* to 23*d* includes a blade that contacts corresponding one of the photoreceptor drums 22*a* to 22*d* and scrapes remaining toner.

In the image holding units 20*a* to 20*d*, the charged rollers 21*a* to 21*d* initially charge the photoreceptor drums 22*a* to 22*d* equally at high potential in darkness, and the photoreceptor drums 22*a* to 22*d* are selectively scanned for exposure based on image data using laser beams 36*a* to 36*d* emitted from the optical scanning unit. As a result, an electrostatic latent image is formed, which includes a low-potential area where electric potential has been attenuated by the exposure and a high-potential area formed by the initial charge. Each of the developing units 31*a* to 31*d* develops a toner image by transferring one of the low-potential area and the high-potential area of the electrostatic latent image for visualization.

Each of the photoreceptor drums 22*a* to 22*d* conveys the toner image toward a primary transfer position to be described later by rotating in the clockwise direction. The latent image and the toner image are formed at a predetermined timing in each of the image holding units 20*a* to 20*d*. As described later, images in different colors such as cyan, magenta, yellow, and black, are primarily transferred in order from the image holding units 20*a* to 20*d* to the intermediate transfer belt 28, where an upper extension surface of the intermediate transfer belt 28 moves in a direction indicated by an arrow P in FIG. 1, and thereby a full-color layered image is held.

In other words, at a moment that a first toner image transferred on the intermediate transfer belt 28 in the imaging unit 71*a* meets a contacting point between the intermediate transfer belt 28 and the photoreceptor drum 22*a*, the photoreceptor drum 22*b* in the imaging unit 71*b* operates like the imaging unit 71*a*. The developing unit 31*b* visualizes the electrostatic latent image on the photoreceptor drum 22*b* to form a second toner image, and conveys the second toner image to transfer it over the first toner image on the intermediate transfer belt 28. At the contacting point, a primary transfer roller 29*a* is located under the intermediate transfer belt 28. This process is repeated in the imaging units 71*c* and 71*d*.

For electrostatic development, metal cores (not shown) of the developing rollers 32*a* to 32*d* are applied with negatively charged bias voltage superposed with alternate current and direct current from a bias supply (not shown). The charged rollers 21*a* to 21*d* are applied with negatively charged bias voltage of a direct current from another bias supply (not shown) to charge the photoreceptor drums 22*a* to 22*d*. For a primary transfer, the primary transfer roller 29*a* and primary transfer rollers 29*b* to 29*c* are provided under the intermediate transfer belt 28 that contacts the photoreceptor drums 22*a* to 22*d*.

The image holding units 20*a* to 20*d* are different in the color of developer. Different colors of the toner such as cyan, yellow, magenta, and black are used as the developer with respect to each image holding unit. The image holding units 20*a* to 20*d* are arranged along the intermediate transfer belt 28 extended in the lateral direction, and the photoreceptor drums 22*a* to 22*d* are arranged in contact with the intermediate transfer belt 28.

The intermediate transfer belt 28 is used for the primary transfer. The intermediate transfer belt 28 includes the upper extension surface that extends in the lateral direction in FIG. 1 contacting the photoreceptor drums 22*a* to 22*d*. A right end of the intermediate transfer belt 28 is supported by a driving roller 26 disposed beyond the right end of the image forming unit 100, and a left end of the intermediate transfer belt 28 is supported by a driven roller 27 disposed at the left of the image forming unit 100 to rotate in an anticlockwise direction. A secondary transfer roller 39 is disposed facing the driving roller 26 to form a secondary transfer unit 50.

The intermediate transfer belt 28 is pressed by the primary transfer rollers 29*a* to 29*d* so that the upper extension surface contacts the photoreceptor drums 22*a* to 22*d*. While the intermediate transfer belt 28 moves with the upper extension surface in contact with the photoreceptor drums 22*a* to 22*d*, the toner images are transferred from the photoreceptor drums 22*a* to 22*d* as described, and a quadruply layered full-color toner image is formed. The full-color toner image is transferred to the recording paper at a time by the secondary transfer roller 39 in the secondary transfer unit 50.

The toner image transferred to the recording paper is fixed by a fixing unit 70, and discharged to a paper receiver 5 via a discharging path 81 by a discharging unit 80 including a pair of rollers. Otherwise, after being fixed, the toner image is recirculated toward the secondary transfer unit 50. The former case is selected for one-side printing, and the latter case is selected for duplex printing.

For the duplex printing, the recording paper is conveyed to a recirculating path 82 to be described later in a direction indicated by an arrow F in FIG. 1 so that the recording surface is reversed before reaching the secondary transfer unit 50 again.

The conveying device includes a container that contains the recording paper and a unit that feeds the recording paper from the container, both of which form the feeding unit 4 provided below the imaging units 71*a* to 71*d*.

The feeding unit 4 includes a paper cassette 40, a feeding roller 41, a friction pad 42, a recording-paper detector 43, a resisting sensor 60, a resisting roller 61, the recirculating path 82, and a path-switching member (not shown). The paper cassette 40 includes a loading plate that is pushed up by a bias member (not shown). The feeding roller 41 feeds the recording paper from the paper cassette 40. The friction pad 42 separates a sheet of the recording paper. The recording-paper detector 43 detects the presence of the recording paper in the paper cassette 40. The resisting sensor 60 determines timing for holding and releasing the recording paper fed from the paper cassette 40 or the recording paper introduced from a reversing path 44 to be described later. The resisting roller 61 supplies the recording paper to the secondary transfer unit 50 according to the timing. The recirculating path 82 and the path-switching member are used for the duplex printing.

According to the embodiment, the feeding roller 41, the resisting sensor 60, and the resisting roller 61 are integrated with the chassis 1A. On the contrary, the paper cassette 40, the friction pad 42, and the reversing path 44 can be detached from the chassis 1A without interference with the chassis 1A. The paper cassette 40 can be of a larger size that accepts large-sized recording paper as indicated by a double-dashed line in FIG. 1.

The recirculating path 82 separates from the discharging path 81, extends downward on the right side of the discharging path in FIG. 1, and communicates with the reversing path 44 that is integrated with the paper cassette 40. A first end of the recording paper that was introduced into the recirculating path 82 and passed through the reversing path 44 returns to the paper path before the resisting roller 61, where the recording paper was initially taken out of the paper cassette 40. The first end is a tail end of the recording paper when originally fed from the paper cassette 40. The recording paper introduced into the recirculating path 82 is then conveyed to the resisting roller 61 to be printed again.

The reversing path 44 is integrated into the paper cassette 40 by molding or the like, and it is formed between a cover 92 integrated with the paper cassette 40 and a conveying guide member 47 that faces the cover 92. The cover 92 includes a handle 93 by which the paper cassette 40 is detached from the chassis 1A.

At least one surface of the reversing path 44 can be exposed so that a user can easily clean the reversing path 44 or fix paper jam. More specifically, a surface of the reversing path 44 is formed by the cover 92 and, by opening the other surface formed by the conveying guide member 47, the surface formed by the cover 92 is exposed.

To expose the surface formed by the cover 92, the conveying guide member 47 can rotationally open or be detached from the cover 92.

Figure 4:
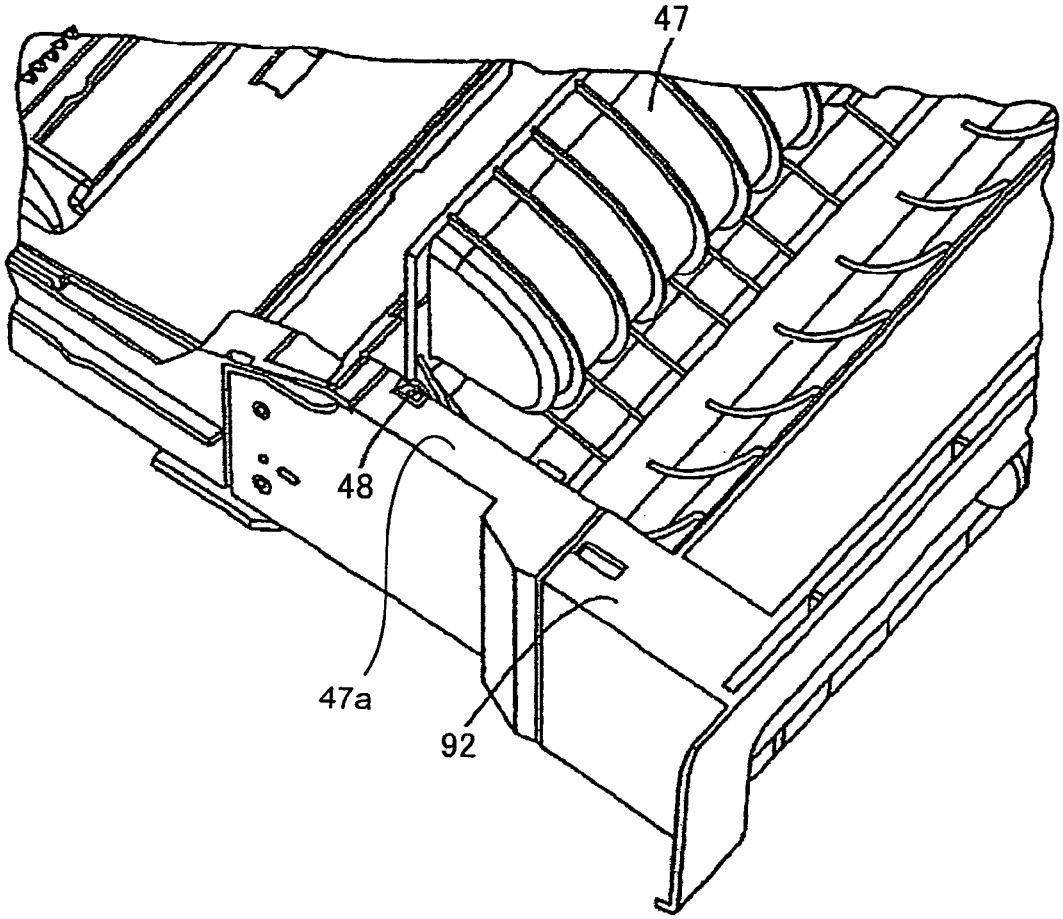
FIG. 4 is an enlarged view of significant components shown in FIG. 3 for explaining how the conveying guide member rotates to open.

To rotationally open the conveying guide member 47, the conveying guide member 47 is configured to rotate around a shaft 48. The shaft 48 is disposed on a side of the conveying guide member 47 closer to the resisting roller 61, i.e., close to the left end of the conveying guide member 47 in FIG. 1. With this configuration, when the paper cassette 40 is inserted into the chassis 1A, a base end of the conveying guide member 47 corresponding to the shaft 48 contacts the insert slot for the paper cassette 40 earlier than a moving end. The conveying guide member 47 rotates toward the cover 92 with the insertion of the paper cassette 40 to form the reversing path 44. Therefore, the reversing path 44 is restored without manually closing the conveying guide member 47. While a closed position of the conveying guide member 47, i.e., a distance from the cover 92 is defined by the moving end of the conveying guide member 47 being latched to a latch or stop portion 47*a* provided in the paper cassette 40(FIG. 4).

To detach the conveying guide member 47, the conveying guide member 47 takes a form of a lid that can be detached from the cover 92. With this configuration, at least one of the surfaces of the reversing path 44 is exposed only by detaching the conveying guide member 47 because the conveying guide member 47 functions as a lid that is disposed at a predetermined distance from the cover 92. To remember attaching the conveying guide member 47, a sensor such as a push switch or the like can be provided at the latch that defines the distance from the cover 92, though not shown in the drawings. The sensor determines whether the conveying guide member 47 has been attached.

With the configuration described above, to print an image only on one side of the recording paper, the discharging unit 80 discharges the recording paper with the image fixed thereon via the discharging path 81 to the paper receiver 5.

On the other hand, to print images on both sides of the recording paper, the discharging unit 80 conveys the recording paper with the image fixed thereon through the discharging path 81, stops just before the first end of the recording paper passes the discharging unit 80, and reverses the rotation of the rollers to switch the recording paper back into the recirculating path 82.

The recording paper is conveyed through the recirculating path 82 and the reversing path 44 until the first end of the recording paper reaches the resisting roller 61, and the resisting roller 61 supplies the recording paper to the secondary transfer unit 50 again.

If the recording paper jams in the reversing path 44 or a contamination on the surface of the reversing path 44 is transferred to the recording paper, the trouble needs to be fixed.

According to the embodiment, if such a trouble occurs, the user can pull the paper cassette 40 out of the chassis 1A to expose at least one surface of the reversing path 44. With the surface of the cover 92 exposed by rotating or detaching the conveying guide member 47, the paper jam can be fixed and the contamination can be cleared.

When the paper cassette 40 is inserted into the chassis 1A, the conveying guide member 47 automatically rotates toward the cover 92, and the conveying guide member 47 is closed if it can rotate, or the conveying guide member 47 is attached to the cover 92 if it can be detached.

Figure 2:
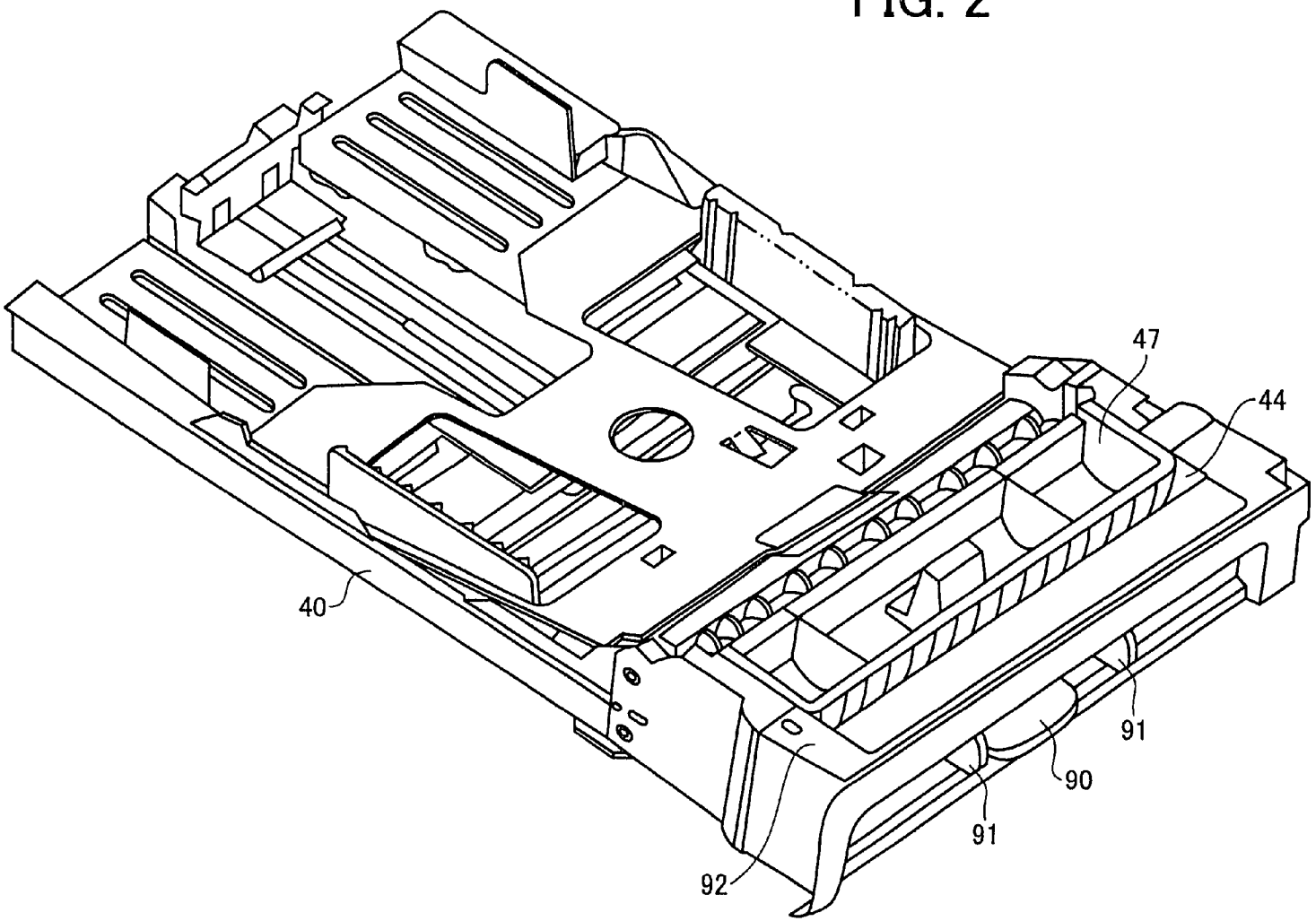
FIG. 2 is a perspective of a feeding unit shown in FIG. 1 that includes a reversing path with a conveying guide member closed.

FIG. 2 is a perspective of the paper cassette 40 with the conveying guide member 47 closed and the surface of the reversing path 44 unexposed. The paper cassette 40 is in this state when it is pulled out of the chassis 1A.

Figure 3:
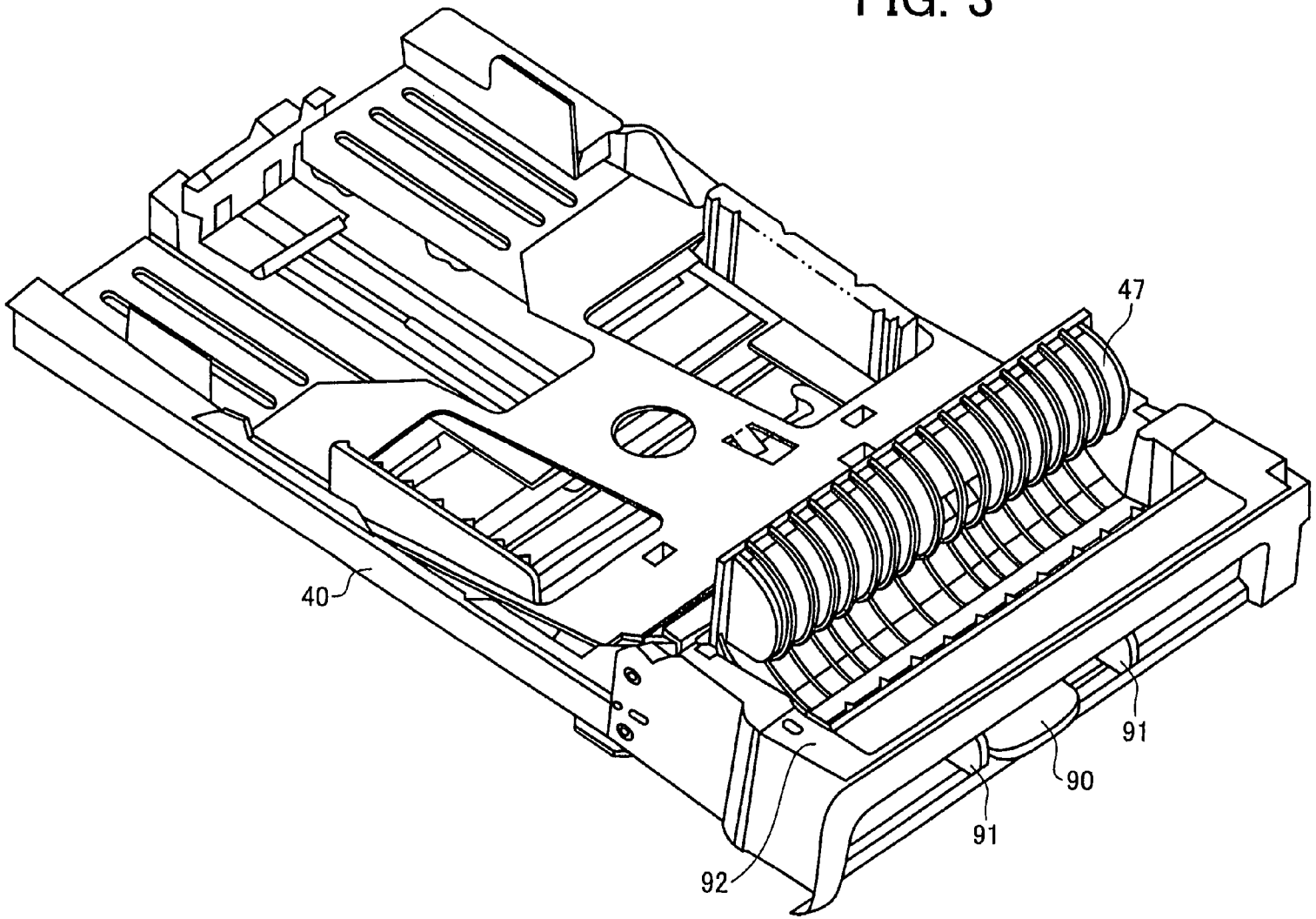
FIG. 3 is a perspective of the feeding unit with the conveying guide member open.

FIG. 3 is a perspective of the paper cassette 40 with the conveying guide member 47 open to expose the surface of the reversing path 44. FIG. 4 is an enlarged view for explaining positional relation between the base end of the conveying guide member 47 and the shaft 48, which are used to open the conveying guide member 47.

A modification of the embodiment is explained below.

As shown in FIG. 1, a manual-feeding path 90 is provided to manually supply the recording paper to the image forming unit 100.

The manual-feeding path 90 extends from an insertion slot for the recording paper to the reversing path 44. The insertion slot is provided in the chassis 1A at a substantially same height as the position at which the feeding roller 41 feeds the recording paper from the paper cassette 40.

The manual-feeding path 90 is slightly aslope at such an angle that the recording paper is conveyed through the reversing path 44 to the resisting roller 61 without being folded. This prevents paper jam in the reversing path 44. The manual-feeding path 90 is further provided with side guide fences 91 that define the position of the recording paper in the width direction (see FIGS. 1, 2, and 3). The side guide fences 91 can slide in the width direction, and prevents the recording paper from being obliquely fed.

As shown in FIG. 1, the cover 92 further includes a feeding path 45. If a large feeding unit (not shown) is attached under the color printer 1, the recording paper is conveyed through the feeding path 45.

According to an aspect of the present invention, because the recirculating path 82 is disposed lateral to the image forming unit 100 and not superposed on the image forming unit 100, the height of the color printer 1 can be reduced.

According to another aspect of the present invention, because at least one surface of the reversing path 44 can be exposed, the user can fix the paper jam or clean the surface of the reversing path 44 easily.

According to still another aspect of the present invention, because the insertion slot of the manual-feeding path 90 is disposed at the substantially same height as the feeding unit 4, the manual-feeding path 90 can be provided within a vertically same range as the feeding unit 4.

According to still another aspect of the present invention, because the shaft 48 is disposed closer to the feeding unit 4, the conveying guide member 47 automatically rotates toward the cover 92 to be closed when the paper cassette 40 is inserted into the chassis 1A, and an extra step to close the conveying guide member 47 by hand is not required.

According to still another aspect of the present invention, because the reversing path 44 is integrated in the cover 92, it can be formed by molding with the cover 92, and thereby number of components and production cost can be reduced.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feeding tray detachably disposed below an image forming unit in a chassis of an image forming apparatus, the paper feeding tray comprising:

a paper cassette arranged to accommodate a blank recording medium, the blank recording medium being fed to the image forming unit by a feeding member that is arranged downstream of the paper cassette along a paper feeding direction inside of the image forming apparatus, the image forming unit being configured to form a first image on a first surface of the blank recording medium and a second image on a second surface of a non-blank recording medium having the first image on the first surface;

a reversing path integrated with and disposed lateral to the paper cassette, the reversing path being continued from a recirculating path that is arranged inside of the image forming apparatus, the reversing path being configured to lead the non-blank recording medium toward the image forming unit; and a component that forms a surface of the reversing path and opens to expose the reversing path, the component being pivotally connected to a cover integrated with the paper cassette via a shaft, having a longitudinal axis orthogonal to a direction of travel of the recording medium in the reversing path, as a rotation axis thereof received on the cover, and while the component is in a closed position, a gap of the reversing path is defined by a moving end of the component engaged with a stop portion of the cover being laterally outside of the reversing path in the direction of travel of the recording medium.

2. The paper feeding tray according to claim 1, further including a manual-feeding path that extends from an insertion slot to join the reversing path, wherein the component guides a paper supplied manually from the insertion slot to the image forming unit, and a joining part of the manual feeding path and the reversing path is exposed by pivotally rotating the component.

3. The paper feeding tray according to claim 2, wherein the insertion slot is disposed in the chassis at a substantially same height as the feeding member.

4. The paper feeding tray according to claim 1, wherein the component rotates toward and away from an other surface so as to expose the reversing path.

5. The paper feeding tray according to claim 1, wherein the component is configured to be detached from the other surface to expose the reversing path.

6. The paper feeding tray according to claim 1, further including an original conveying path configured to lead the blank recording medium fed by the feeding member, wherein a downstream end of the reversing path along a conveying direction of the non-blank recording medium joins to the original conveying path at an inner portion of the paper feeding tray.

7. The paper feeding tray according to claim 1, wherein the surface of the reversing path is formed with the cover of the paper feeding tray.

8. The paper feeding tray according to claim 7, wherein the cover includes a handle arranged near the reversing path and configured to be held by a user when the paper feeding tray is attached and detached to the image forming apparatus.

9. An image forming apparatus comprising:

an image forming unit configured to form a first image on a first surface of a blank recording medium and a second image on a second surface of a non-blank recording medium having the first image on the first surface;

a recirculating path configured to lead the non-blank recording medium toward the image forming unit;

a paper feeding tray detachably disposed in a chassis of the image forming apparatus and having a paper cassette being configured to accommodate the blank recording medium; and a paper feeding member configured to feed the blank recording medium from the paper feeding tray, wherein the paper feeding tray further includes:

a reversing path integrated with and disposed lateral to the paper cassette, the reversing path being continued from the recirculating path; and a component that forms a surface of the reversing path and opens to expose the reversing path, the component being pivotally connected to a cover integrated with the paper cassette via a shaft, having a longitudinal axis orthogonal to a direction of travel of the recording medium in the reversing path, as a rotation axis thereof received on the cover, and while the component is in a closed position, a gap of the reversing path is defined by a moving end of the component engaged with a stop portion of the cover being laterally outside of the reversing path in the direction of travel of the recording medium.

10. The image forming apparatus according to claim 9, further including a manual-feeding path that extends from an insertion slot to join the reversing path, wherein the component guides a paper supplied manually from the insertion slot to the image forming unit, and a joining part of the manual feeding path and the reversing path is exposed by pivotally rotating the component.

11. The image forming apparatus according to claim 10, wherein the insertion slot is disposed in the chassis at a substantially same height as the feeding member.

12. The image forming apparatus according to claim 9, wherein the component rotates toward and away from an other surface to expose the reversing path.

13. The image forming apparatus according to claim 9, wherein the component is configured to be detached from the other surface so as to expose the reversing path.

14. The image forming apparatus according to claim 9, wherein the paper feeding tray further includes an original conveying path configured to lead the blank recording medium fed by the feeding member, wherein a downstream end of the reversing path along a conveying direction of the non-blank recording medium joins to the original conveying path at an inner portion of the paper feeding tray.

15. The image forming apparatus according to claim 9, wherein the surface of the reversing path is formed with the cover of the paper feeding tray.

16. The image forming apparatus according to claim 15, wherein the cover includes a handle arranged near the reversing path and configured to be held by a user when the paper feeding tray is attached and detached to the image forming apparatus.

* * * * *